United States Patent [19]

Nidola et al.

[11] 4,040,914

[45] Aug. 9, 1977

[54] CATHODE STARTING BLANKS FOR METAL DEPOSITION

[75] Inventors: Antonio Nidola; Placido M. Spaziante, both of Milan, Italy; Vittorio de Nora, Nassau, Bahamas

[73] Assignee: Diamond Shamrock Technologies S.A., Geneva, Switzerland

[21] Appl. No.: 680,982

[22] Filed: Apr. 28, 1976

[51] Int. Cl.[2] ..... C25D 1/20; C25C 7/08; C25B 11/10

[52] U.S. Cl. ..... 204/12; 204/275; 204/281; 204/290 F

[58] Field of Search ..... 204/281, 242, 12, 290 F, 204/275

[56] References Cited

U.S. PATENT DOCUMENTS

| | | | |
|---|---|---|---|
| 1,941,376 | 12/1933 | Wilkins | 204/281 |
| 3,779,872 | 12/1973 | Bomberger, Jr. | 204/281 X |
| 3,829,366 | 8/1974 | Ives et al. | 204/281 X |

FOREIGN PATENT DOCUMENTS

| | | | |
|---|---|---|---|
| 904,490 | 8/1954 | Germany | 204/290 F |

*Primary Examiner*—John H. Mack
*Assistant Examiner*—D. R. Valentine
*Attorney, Agent, or Firm*—Hammond & Littell

[57] ABSTRACT

Improved cathode starting blanks for metal electrowinning are produced when valve metal sheets are coated with a thin layer containing either silver or silver-valve metal alloys, particularly silver-yttrium alloys, and/or oxides thereof. Said blanks are used in the electro-deposition of strippable metal coatings such as in electrowinning and/or electro-refining of metals. The improved method of recovering a metal from an electrolyte using these cathode blanks and the electrowinning cells containing said cathode blanks are also a part of the invention.

19 Claims, 3 Drawing Figures

FIG. 1
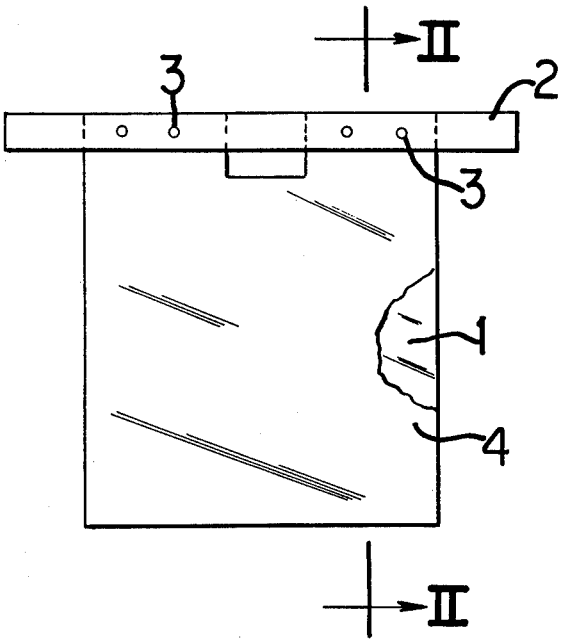
FIG. 2
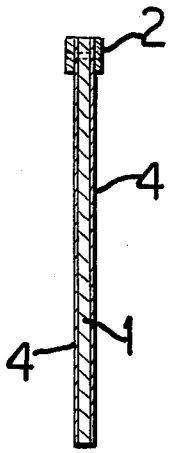
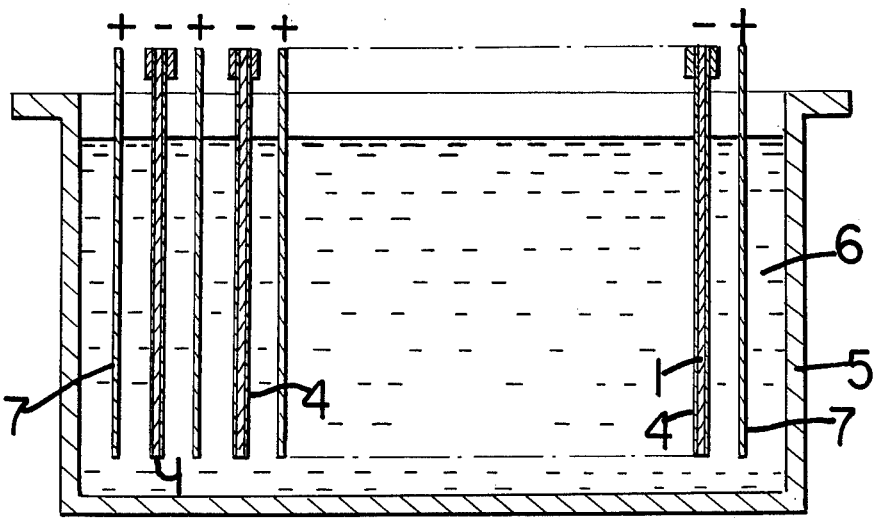
FIG. 3

CATHODE STARTING BLANKS FOR METAL DEPOSITION

STATE OF THE ART

In the electrolytic production and refining of metals, an aqueous electrolyte containing ions of the metal to be won is electrolyzed between an anode and a cathode whereby the metal is deposited on the cathode. The anode may be made of the metal being refined, in which case the anode dissolves as the refined metal is deposited on the cathode, or the anode may be made of a non-consumable material and hence the metal deposition is accompanied by a depletion of the metal ions from the electrolyte which is usually circulated through the electrolysis cell at a rate sufficient to maintain an optimum concentration.

The starting cathode blanks may be made either of the same metal which is being deposited or from some other metal. In latter case, the metal deposit is grown to a certain thickness and then the cathode is removed from the cell and the deposited metal is stripped from the starting cathode blank which is then put back into the cell. Usually the blanks are made of titanium, aluminum or other valve metals which are sufficiently resistant to corrosion in the acidic solutions used in electrowinning and electro-refining.

The recoverable metal deposited on the cathode blanks should grow as a dense and uniform metal deposit and the degree of adhesion of the metal deposit to the blank should be sufficient to hold the weight of the growing metal deposit but should not be excessive in order to permit easy stripping of the metal deposit from the cathode blank. When automatic stripping machines are used, this latter requirement is very important since in a metal refinery thousands of blanks may be continuously utilized and any laborious manual intervention should be minimized for the overall economics of the production process.

Starting blanks of titanium and aluminum as they are used at present have some limitations. For example, if halide ions such as $F^-$, $Br^-$ and $Cl^-$ are present in the electrolyte, the blanks are slightly corroded even under cathode polarization. This means that the protective oxide film formed on the valve metal surface dissolves and as a consequence, the electro-deposited metal strongly adheres to the blank making its removal difficult. This situation is typical in the case of zinc deposition on aluminum starting blanks when traces of $F^-$, $SiF_6^{1-}$, $Br^-$, $Cl^-$ are present in the electrolyte even at concentrations as low as 1–2 ppm.

OBJECTS OF THE INVENTION

It is an object of the invention to provide novel cathode valve metal blanks for the electrowinning of metals provided with a suitable coating.

It is another object of the invention to provide an improved electrowinning method as well as an improved electrowinning cell.

These and other objects and advantages of the invention will become obvious from the following detailed description.

THE INVENTION

The considerably improved metal cathode blanks of the invention are comprised of a valve metal base such as Ti, Ta, Nb, V, Zr, Al, Y, etc. or alloys thereof coated with a thin layer containing either silver or silver-valve metal alloys, and particularly silver-ytrium alloys, and/or oxides thereof.

This invention also provides an improved method of extracting a metal from an electrolyte which comprises impressing a direct electric current on the electrolyte contained between an anode and a cathode blank, wherein the cathode blank comprises a valve metal base such as Ti, Ta, Nb, V, Zr, Hf, Al, Y etc. or alloys thereof coated with a thin layer containing either silver or silver-valve metal alloys, particularly silver-yttrium alloys, and/or oxides thereof, preferably in a thickness of 1 to 50$\mu$.

The cathode starting blanks of the invention show an outstandingly improved corrosion resistance. The thin oxide film at the interphase between the cathode blank and the metal deposit, which film plays an important part with respect to the degree of adherence between the blank and the metal deposit, is not leached out by the acidic electrolytes which often contain traces of halogen ions such as $F^-$, $SiF_6^{4-}$, $Br^-$ and $Cl^-$ and the stripping of the metal deposit from the blank is greatly facilitated.

This invention preferably provides an oxide film at the interphase between the cathode blank and the metal deposit and this oxide film is far more stable under the conditions of an electrowinning operation than the oxide films which can be obtained by subjecting the valve metal base to oxidization.

The cathode starting blanks of this invention also show additional advantages as the thin oxide film of silver has an electronic conductivity of the same order as that of metals. Therefore, the electronic transfer at the cathode is greatly enhanced, and the morphology of the metal deposit is very good which is believed to be due to the high hydrogen overvoltage of the coated metal blanks of this invention.

It is known that the morphology and quality of the metal deposit is strongly dependent on the rate of the unwanted side reaction represented by hydrogen evolution. If hydrogen evolution takes place simultaneously with the metal deposition, porous spongy or brittle deposits are formed with the following consequences:

a. very poor cathode deposit morphology
b. loss of metal faraday efficiency
c. contamination of the metal deposit due to salts, colloids etc. being trapped in the pores of the deposit.

These phenomena tend to increase with the increasing thickness of the metal deposit. If the first layers of a metal deposit are morphologically bad, the next layers tend to show a further deterioration of the morphology leading to an unsatisfactory metal deposit. Conversely, if no hydrogen evolution occurs on the starting cathode blanks, such as in the case of the blanks of this invention, the first layers of the metal deposit are smooth and compact; as a consequence, the next layers, the morphology of which is sharply affected by the first layers, show a satisfactory structure.

DESCRIPTION OF THE PREFERRED EMBODIMENTS

A typical electrolytic cell for the electrowinning of metals from aqueous acidic electrolytes comprises a tank of a corrosion-resistant material containing the electrolyte, at least one anode connected to the positive current distribution bars and at least one cathode facing said anode and connected to the negative current distribution bars, both immersed in the electroyte. Fresh electrolyte is added at one end and depleted electrolyte is discharged at the other end of the tank.

The anode may be a consumable material such as lead or lead alloys, graphite etc. or it may be a dimensionally stable anode such as those described in U.S. Pat. Nos. 3,632,498; 3,751,296; 3,878,083; 3,775,284 and 3,428,544. These anodes usually comprise a valve metal base coated over at least a portion of its outer surface, with either a platinum group metal or a platinum group metal oxide such as $RuO_2$, $RhO_2$, $PdO_2$, $OsO_2$, $IrO_2$, $PtO_2$ with or without other metal oxides.

The starting cathode blanks of this invention comprise a sheet of valve metal or valve metal alloy covered over at least the portion of the surface in contact with the electrolyte, with a thin layer containing either silver or silver-valve metal alloys, and particularly a silver-yttrium alloy, and/or oxides thereof. Suitable valve metals are titanium, tantalum, niobium, hafnium, aluminum, yttrium or alloys thereof such as for example, Ti—Pd, Ti—Ni alloy, etc. Particularly preferred are the cathode coating of silver oxide, silver-valve metal alloys with at least 15% by weight of silver and oxides of said alloys. However, other metals and alloys showing typical valve metal characteristics under the conditions existing in electrowinning, electro-refining and electroplating cells are equally suitable. The amount of silver in the silver-valve metal alloy and particularly the silver-yttrium alloy, or the oxides thereof should be more than 15% by weight of the metal.

The thickness of the coating may be on the order of a few microns preferably between 1 and 50 microns and usually the amount of coating based on the surface area should be within the range of 1 to 25 g/m$^2$ or more. Tests have shown that a slightly porous silver or silver alloy coating is not detrimental to the performance of the cathode blanks of the invention. The coating may be applied on the valve metal base by ordinary methods such as those illustrated in the following examples. However, other methods such as vacuum sputtering or plasma jet techniques may also be used.

Preferred but not limitative embodiments of the invention are described in greater detail with references to the appended drawings in which:

FIG. 1 is a front view of a starting cathode blank and

FIG. 2 is an enlarged sectional view of the cathode blank of FIG. 1 taken along line II—II.

FIG. 3 is a simplified cross-sectional view of an electrowinning cell of the invention.

The starting cathode blank schematically illustrated in FIG. 1 comprises a titanium sheet 1 which is coated according to the invention and which is riveted by rivets 3 to an electrically conducting suspension bar 2. The latter supports the blank when it is immersed in the electrolyte solution and also provides the means by which the starting cathode blank is connected to the negative pole of the power supply. FIG. 2 is an enlarged sectional view of the starting cathode blank along line II—II of FIG. 1. The titanium sheet 1 is covered over both surfaces with a thin layer 4 comprising either silver or a silver-valve metal alloys, particularly silver-yttrium alloy and/or oxides thereof. The sheet is riveted to the electrically conducting suspension bar 2.

FIG. 3 is a simplified cross-section of a typical electrowinning cell similar to the cells to recover copper from copper sulfate solutions. The cell substantially consists of a corrosion sulfate solutions. The cell substantially consists of a corrosion resistant tank 5 containing the electrolyte 6, a series of anodes 7 electrically connected to the positive pole of the power supply and a series of starting cathode blanks 1 of the invention disposed in functional relationship with said anodes. Means not shown in the drawing, are provided to circulate the electrolyte through the cell to maintain the concentration and the volume of the electrolyte in the cell substantially constant.

In the following examples there are described several preferred embodiments to illustrate the invention. However, it should be understood that the invention is not intended to be limited to the specific embodiments.

EXAMPLE 1

Silver was electro-deposited on a degreased or sandblasted and/or slightly etched titanium sheet or blank using commercial cyanide baths operating at a very low current density. The composition and working conditions of one such bath was as follows:

| | |
|---|---|
| NaCN | 50 to 150 g/l |
| $Ag(CN)_2$ | 10 to 100 g/l |
| NaOH | 10 to 100 g/l |
| Current density | 1 to 100 A/m$^2$ |
| Temperature | ≦25° C |
| Silver thickness | 1 to 20 μ |

The bath was stirred during the deposition. The coated blanks may be pre-oxidized before use in electrowinning and electro-refining by treating the blanks in an oven under forced air circulation at a temperature between 250° and 350° C for 5 to 20 minutes. Under these conditions, a partial conversion of the silver metal into a stable and highly conductive $Ag_2O$ phase takes place.

EXAMPLE 2

A layer of silver oxide was formed on a degreased, sandblasted and/or slightly etched titanium sheet by the application of a number of coats of a solution containing thermally reducible silver salts. After each application, the solution was dried and the sample was heated in an oven under forced air circulation at a temperature between 250° and 320° C for 5 to 15 minutes. These operations were repeated until a coating thickness ranging from 1 to 50 μ was obtained.

A preferred coating solution was an aqueous solution of 100 mg/ml of $AgNO_3$ and 1 ml of $NH_4OH$ (25%). An organic solution was comprised of 200 mg/ml of silver resinate, 0.9 ml of xylol and 0.1 ml of isopropyl alcohol.

EXAMPLE 3

Deposition of a silver-yttrium alloy on a degreased or sandblasted and/or a slightly etched titanium sheet was effected by dipping the titanium sheet in a molten bath of silver salts, yttrium salts and NaF maintained at a temperature slightly over the melting point of the salt mixture. Under these conditions, a thin layer of Ag—Y alloy was deposited on the titanium surface which may be used as such or may be oxidized before use as described in Example 1.

EXAMPLE 4

The deposition of silver-yttrium oxides on a cleaned titanium base was made following the procedures described in Example 2. Preferred coating solutions are the following:Inorganic solution comprising 100 mg/ml of $AgNO_3$, 20 mg/ml of $Y(NO_3)_3$ and 1 ml of $HNO_3$ (1%). Organic solution comprising 200 mg/ml of silver resinate, 80 mg/ml of yttrium resinate, 0.9 ml xylol and 0.1 ml of isopropyl alcohol.

Tantalum, niobium, vanadium zirconium, hafnium, aluminum, yttrium and other valve metals or valve metal alloys may be used in the place of titanium with the same coating conditions as described in the illustrative examples. The chemi-deposited coatings may be applied in 1 to 20 successive coats as desired.

Other coatings of silver-valve metal alloy or of the oxides thereof have been prepared according to the procedures described in the preceeding examples. Most satisfactory results have been obtained by thermally depositing silver-yttrium oxides, silver-zirconium oxides and silver-tantalum oxides with a concentration of silver in the coating greater than 15% by weight as metal.

The cathode starting blanks of valve metal coated in accordance with this invention have been successfully used in the electrowinning of metals from sulfate solutions such as in the electrowinning of copper, nickel and cobalt, of from chloride solutions such as in the electrowinning of nickel and cobalt and from mixed solutions containing both sulfates and chlorides such as in the electrowinning of nickel, cobalt and zinc. The blanks have also been used in the electrolytic recovery of other metals.

EXAMPLE 5

Nickel was electrodeposited from an aqueous electrolyte of nickel chloride containing 80 gpl calculated as metal and 20 to 40 gpl of $H_3BO_3$ as a buffering agent in a cell with 2 titanium anodes with an electrically conductive electrocatalytic coating thereon and a titanium cathode with a $Ag_2O$ coating prepared by Example 1 therebetween measuring 600 mm × 400 mm. As asbestos diaphragm 1.5 mm thick was used to separate anolyte and catholyte compartments and the electrodic gap was 80 mm. Electrolysis was effected at a temperature of 60°-80° C and a cathode current density of 300 A/m$^2$.

6 mm of nickel were deposited over both faces of the flat cathode operating at high efficiency. The quality of the deposit obtained was very good and the metallic deposit was free from dentrites, of uniform thickness and mechanically stable. Stripping of the metal deposit was comparatively easier than that experienced with uncoated titanium blanks.

EXAMPLE 6

Copper was electro-deposited from an electrolyte solution containing $CuSO_4$ using a cathode starting blank according to Example 2 similar to the one illustrated in FIGS. 1 and 2.

The operation conditions were the following:

| | |
|---|---|
| Electrolyte: $CuSO_4$ | 40 gpl as metallic Cu |
| $H_2SO_4$ | 150 to 200 gpl |
| Current density (cathodic) | 300 A/m$^2$ |
| Cathode dimensions | 700 mm × 400 mm |
| Cathode: titanium coated with $Ag_2O$ according to Example 2 | |
| Anode: titanium provided with an electrically conducting electrocatalytic coating | |
| Interelectrodic distance | 90 mm |
| Temperature | 60° to 80° C |

6 mm were deposited over both faces of the flat cathode at high overall efficiency. The quality of the deposit was very good and the deposit was substantially free from dentrites and had good mechanically stability. The thickness of the deposit was substantially uniform over the entire cathodic surface and stripping of the metal deposit was comparatively very easy.

EXAMPLE 7

Zinc was electro-deposited from an electrolyte solution containing $ZnSO_4$, using a cathode starting blank of Example 3 and the operating test conditions were the following:

| | |
|---|---|
| Electrolyte: $ZnSO_4$ | 60 gpl as metallic Zn |
| $H_2SO_4$ | 150 to 200 gpl |
| Current density (cathodic) | 300 A/m$^2$ |
| Cathode dimensions | 600 mm × 400 mm |
| Cathode: titanium provided with an oxidized silver-yttrium coating of Example 3 | |
| Anode: titanium provided with an electrically conducting electrocatalytic coating | |
| Interelectrodic distance | 80 mm |
| Temperature | 30° to 35° C |

3 mm of zinc were deposited over both faces of the flat cathode at high overall efficiency. The quality of the deposit was very good and the deposit was substantially free from dentrites and had good mechanically stability. The thickness of the deposit was substantially uniform over the entire cathodic surface and stripping of the metal deposit from the blank was exceptionally easy.

EXAMPLE 8

Cobalt was electro-deposited from an electrolyte solution containing $CoSO_4$, using a cathode starting blank of Example 4 and the operating conditions were the following:

| | |
|---|---|
| Electrolyte: $CoSO_4$ | 80 gpl as metallic Co |
| $H_2SO_4$ | to a pH of 2 |
| Current density (cathodic) | 300 A/m$^2$ |
| Cathode dimensions | 700 mm × 400 mm |
| Cathode: titanium provided with a layer of silver-yttrium oxides | |
| Anode: titanium provided with an electrically conductive electrocatalytic coating | |
| Interelectrode gap | 90 mm |
| Temperature | 60° to 80° C |

The cathode was between two anodes and 6 mm of cobalt were deposited over both faces of the flat cathode blank at high overall efficiency. The quality of the deposit was very good and the deposit was substantially free from dentrites and had good mechanically stability. Stripping of the metal deposit from the blank was exceptionally easy.

EXAMPLE 9

Nickel was electro-deposited from an electrolyte solution containing $NiSO_4$, using a cathode starting blank of titanium provided with a coating of $Ag_2O.TiO_2$ with a metal ratio Ag/Ti of 2/1 applied by thermal decomposition of a solution containing thermally reducible salts of Ag and Ti according to a procedure similar to that described in Example 4. The operating conditions were the following:

| | |
|---|---|
| Electrolyte: $NiSO_4$ | 80 gpl as metallic Ni |
| $H_2SO_4$ | to a pH of 2 |
| Current density (cathodic) | 300 A/m$^2$ |
| Cathode dimensions | 700 mm × 400 mm |
| Anode: titanium provided with | |

-continued

| | |
|---|---|
| an electrically and electro-catalytic coating | |
| Interelectrode gap | 90 mm |
| Temperature | 60° to 80° C |

6 mm of nickel were deposited over both faces of the flat cathode at high overall efficiency. The quality of the deposit was very good and the deposit was substantially free from dentrites and had good mechanical stability. Stripping of the metal deposit was exceptionally easy. The examples describe the application of our invention to electrorefining or electrowinning. Cathode starting blanks according to this invention may be used in other electrolytic processes such as electro-plating or electro-refining where the metal deposit is to be removed from the cathode.

In order to facilitate the stripping of the deposited metal from the blank, especially when automatic stripping machines are used, the known practices of applying insulating strips over the edges of the blanks to avoid the complete enveloping of the cathode starting blank by part of the metal deposit may be used according to the techniques known in the art.

Various modifications of the cell and method of the invention may be made without departing from the spirit or scope thereof and it is to be understood that the invention is intended to be limited only as defined in the appended claims.

What is claimed is:

1. A cathode starting blank for electrolytically depositing a strippable metal layer from a metal containing electrolyte comprising a valve metal base coated over at least a portion of its surface with a thin layer containing a material selected from the group consisting of silver oxide, a silver-valve metal alloy and oxides of said alloy.

2. The cathode starting blank of claim 1 wherein the valve metal base is selected from the group consisting of titanium, tantalum, niobum, vanadium, zirconium, hafnium, aluminum and yttrium and alloys thereof.

3. The cathode starting blank of claim 1 wherein the coating has a thickness of between 1 and 50 microns, contains between 1 and 25 g/m$^2$ of said metals or oxides thereof and contains at least 15% of silver by weight of metal in said coating.

4. The cathode starting blank of claim 1 wherein the coating is a silver-yttrium alloy or oxides thereof.

5. The cathode starting blank of claim 1 wherein the base is titanium and the coating is electro-deposited silver oxidized in air at a temperature between 250° and 350° C for a period of between 5 and 20 minutes.

6. The cathode starting blank of claim 1 wherein the coating is a thermally deposited layer of silver-valve metal alloy heat treated in air at a temperature between 250° and 350° C for a period of between 5 and 20 minutes.

7. The cathode starting blank of claim 1 wherein the coating is a thermally-deposited layer from the group containing of silver oxide and silver-metal alloys and oxides of said alloys having at least 15% by weight of silver therein.

8. The cathode starting blank of claim 7 wherein the base is titanium and the coating is principally chemi-deposited oxides of silver and yttrium.

9. The cathode starting blank of claim 7 wherein the base is titanium and the coating is principally oxides of silver and yttrium containing at least 15% by weight of silver.

10. The cathode starting blank of claim 1 having means for attachment to a direct current source in an electrowinning or electro-deposition cell.

11. An electrolysis for electrolytically depositing a metal from a metal-bearing electrolyte solution comprising a tank having an inlet and outlet adapted to maintain a substantially constant volume of electrolyte at a substantially constant concentration, at least one anode and at least one valve metal cathode starting blank immersed in said electrolyte with their electrically conductive surfaces in functional relationship to each other and electrically connected respectively to the positive and negative poles of a direct current source, said cathode starting blank having over at least a portion of its outer surface a thin layer of at least one member of the group consisting of silver oxide, silver-valve metal alloys and oxides of said alloys.

12. The electrolysis cell of claim 11 wherein the thin layer is selected from the group consisting of silver oxide, silver-yttrium alloy containing at least 15% by weight of silver and oxides of said alloy.

13. The electrolysis cell of claim 11 wherein the thin layer is silver oxide.

14. The electrolysis cell of claim 12 wherein the layer is a mixture of silver-yttrium oxides.

15. The electrolysis cell of claim 11 wherein the layer is selected from the group consisting of silver-titanium oxides, silver-zirconium oxides and silver-tantalum oxides containing at least 15% by weight of silver calculated as metal.

16. In the method of electrolytically depositing a strippable metal layer on a cathode starting blank from a metal containing electrolyte and stripping the metal deposit from the blank, the improvement wherein the cathode starting blank comprises a valve metal base coated over at least a portion of its surface with a thin layer containing a material selected from the group consisting of silver, silver-valve metal alloy and oxides thereof.

17. The process of claim 16 wherein the valve metal base is selected from the group consisting of titanium, tantalum, niobium, vanadium, zirconium, hafnium, aluminum and yttrium and alloys thereof.

18. The process of claim 16 wherein the cost has a thickness of between 1 and 50 microns, contains between 1 and 25 g/m$^2$ of said metals or oxides thereof and contains at least 15% of silver by weight of metal in said coating.

19. The process of claim 16 wherein the coating is a silver-yttrium alloy or oxides thereof.

* * * * *